US005247910A

United States Patent [19]

Abe

[11] Patent Number: 5,247,910

[45] Date of Patent: Sep. 28, 1993

[54] AIR-FUEL RATIO CONTROL APPARATUS

[75] Inventor: Chikanori Abe, Aichi, Japan

[73] Assignee: NGK Spark Plug Co., Ltd., Aichi, Japan

[21] Appl. No.: 15,534

[22] Filed: Feb. 9, 1993

[30] Foreign Application Priority Data

Feb. 13, 1992 [JP] Japan ..... 4-026947

[51] Int. Cl.[5] ..... F02D 41/14

[52] U.S. Cl. ..... 123/688; 123/435; 123/695

[58] Field of Search ..... 123/435, 679, 688, 693, 123/694, 695

[56] References Cited

U.S. PATENT DOCUMENTS

| | | | |
|---|---|---|---|
| 4,177,787 | 12/1979 | Hattori et al. | 123/688 X |
| 4,214,563 | 7/1980 | Hosaka | 123/688 X |
| 4,519,366 | 5/1985 | May | 123/435 |
| 4,624,232 | 11/1986 | Saito et al. | 123/695 |
| 4,930,478 | 6/1990 | Plee et al. | 123/435 X |
| 4,938,194 | 7/1990 | Kato et al. | 123/688 |
| 5,058,552 | 10/1991 | Shimomura et al. | 123/425 |
| 5,065,728 | 11/1991 | Nakaniwa | 123/688 X |

FOREIGN PATENT DOCUMENTS

| | | | |
|---|---|---|---|
| 224436 | 12/1984 | Japan | 123/695 |

*Primary Examiner*—Willis R. Wolfe

*Attorney, Agent, or Firm*—Finnegan, Henderson, Farabow, Garrett & Dunner

[57] ABSTRACT

A control unit for controlling an injection amount of a fuel injection valve and performing an air-fuel ratio control of an engine has an oxygen sensor for detecting an air-fuel ratio in an exhaust outlet and an electrode plug for measuring a flame resistance value in a combustion chamber. The control unit calculates a reference air-fuel ratio from an average value of the minimum values of the flame resistance measured by the electrode plug, obtains a correction coefficient from the air-fuel ratio detected by the oxygen sensor and the reference air-fuel ratio, and then corrects the air-fuel ratio detected by the oxygen sensor. The control unit performs the air-fuel ratio control of the engine based on the corrected air-fuel ratio.

2 Claims, 6 Drawing Sheets

AIR-FUEL RATIO CONTROL APPARATUS

BACKGROUND OF THE INVENTION

The present invention relates to an air-fuel ratio control apparatus for controlling the air-fuel ratio of an engine depending on an oxygen concentration in exhaust gas detected by an oxygen sensor.

There are various known oxygen sensors including a sensor (a λ point oxygen sensor) in which the output value greatly changes in the vicinity of the theoretical air-fuel ratio so that an air-fuel ratio in the vicinity of the theoretical air-fuel ratio is detected, and a sensor (a wide range oxygen sensor) which generates an output value for detecting an air-fuel ratio in a wide range from a lean state to a rich state.

A control apparatus controls the air-fuel ratio of an engine by performing a feedback correction depending on an air-fuel ratio detected by an oxygen sensor.

Since such an oxygen sensor is exposed to exhaust gas for a long period, a value of the detected air-fuel ratio may vary due to a performance deterioration of the oxygen sensor caused by a thermal and or a chemical attack of exhaust gas.

In a specific example, as shown by a solid line B in FIG. 10, in a λ point oxygen sensor, the air-fuel ratio at which the output is greatly changed (the theoretical air-fuel ratio point to be detected) is shifted to the richer side as the sensor is used for a long period. In a wide range oxygen sensor, as shown in FIG. 11 , the output (a pump current) decreases from a value shown by a solid line C to a value shown by a one-dot chain line D as the sensor is used for a long period.

In this way, the value of the air-fuel ratio detected by an oxygen sensor varies as the oxygen sensor is used for a long period. Therefore, a prior art air-fuel ratio control apparatus cannot properly control the air-fuel ratio of an engine for a long period.

SUMMARY OF THE INVENTION

The present invention has been made in view of the above circumstances, and has an object of providing an air-fuel ratio control apparatus which can accurately measure the air-fuel ratio with an oxygen sensor and properly control the air-fuel ratio of an engine, even when the oxygen sensor is used for a long period.

The air-fuel ratio control apparatus according to the present invention (see FIG. 1) comprises an oxygen sensor 14 provided in an exhaust outlet 12 of an engine 11 and for detecting an oxygen concentration in exhaust gas, and a control unit 15 for correcting and controlling the air-fuel ratio of the engine 11 depending on the oxygen concentration in the exhaust gas detected by the oxygen sensor 14. The control unit 15 comprises an electrode plug 18 for detecting a flame resistance in a combustion chamber of the engine 11. The control unit 15 further comprises air-fuel ratio calculation means 6 for calculating an air fuel ratio from a minimum value of the flame resistance detected by the electrode plug 18, and air-fuel ratio correction means 7 for correcting the air-fuel ratio detected by the oxygen sensor 14, using the air-fuel ratio calculated by the air-fuel ratio calculation means 6. Thus, the control unit 15 corrects and controls the air-fuel ratio of the engine 11 based on the air-fuel ratio corrected by the air-fuel ratio correction means 7.

In the control apparatus, the air-fuel ratio calculation means calculates a reference air-fuel ratio from the minimum value of the frame resistance detected by the electrode plug. The reference air-fuel ratio calculated by the air-fuel ratio calculation means and the air-fuel ratio detected by the oxygen sensor are compared with each other by the air-fuel ratio correction means. In accordance with the difference between them, the air-fuel ratio detected by the oxygen sensor is corrected. Then, the control unit controls the air-fuel ratio of the engine based on the air-fuel ratio corrected by the air-fuel ratio correction means.

The reference air-fuel ratio obtained from a flame resistance is not substantially influenced by aged deterioration of the control apparatus. Therefore, even if the oxygen sensor is used for a long period and the air-fuel ratio detected by the oxygen sensor is changed, the air-fuel ratio detected by the oxygen sensor can be corrected based on the reference air-fuel ratio measured by the electrode plug, thereby properly controlling the air-fuel ratio of the engine.

DETAILED DESCRIPTION OF THE INVENTION

Figure 1:
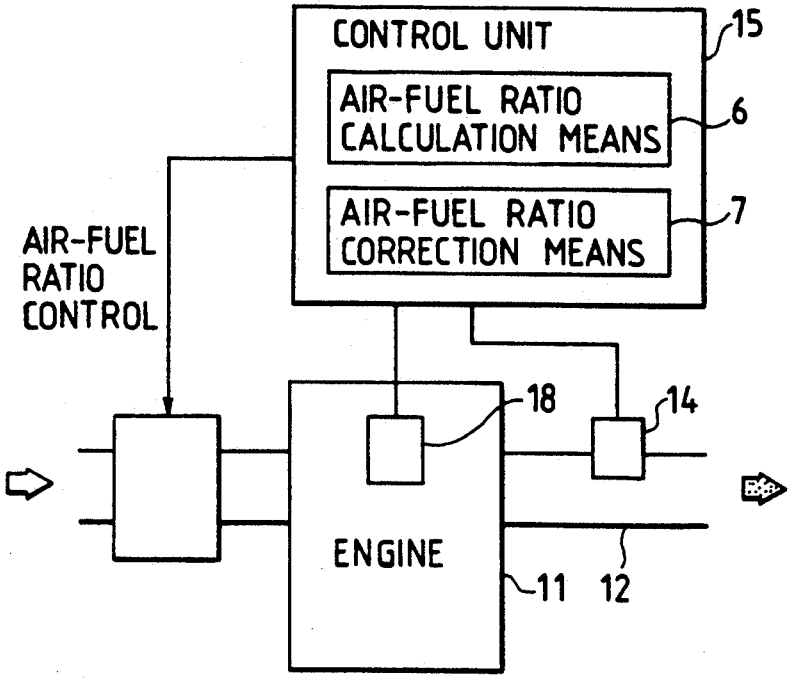
FIG. 1 is a block diagram showing the structure of the present invention.

Hereinafter, the air-fuel ratio control apparatus of the present invention will be described with respect to preferred embodiments shown in the drawings.

Figure 2:
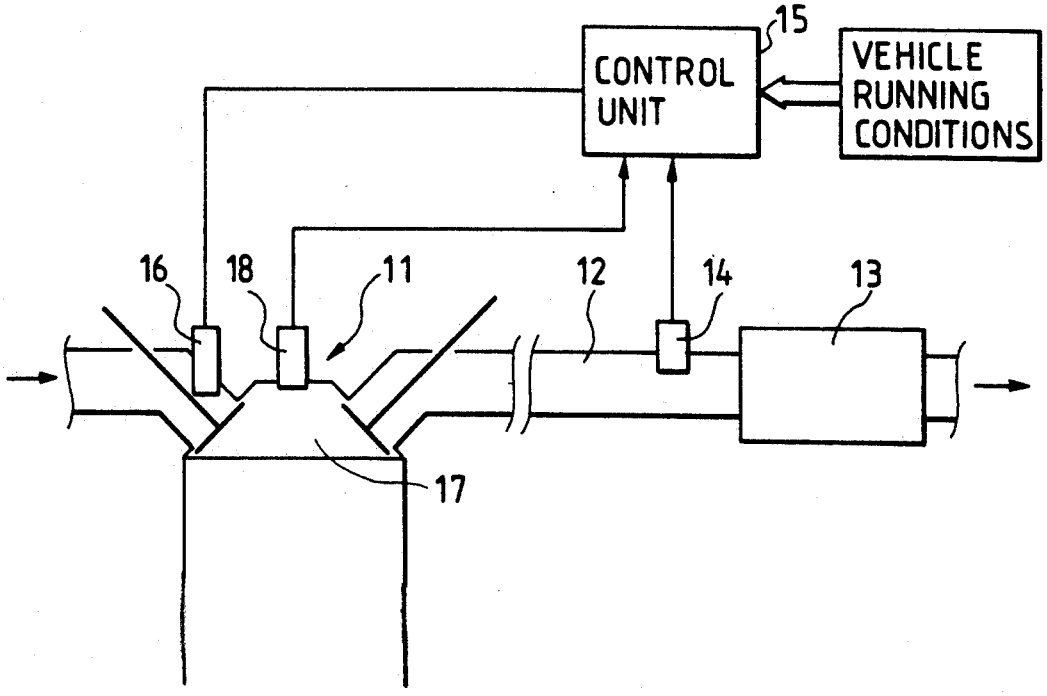
FIG. 2 is a schematic diagram showing the structure of an air-fuel ratio control apparatus,.of the present invention.

FIGS. 2 to 8 show an embodiment of the invention. FIG. 2 is a schematic diagram showing the structure of the air-fuel ratio control apparatus.

In an engine 11, a ternary catalyst 13 for purifying exhaust gas is disposed in an exhaust outlet. 12. To the exhaust outlet 12 on the upstream side of the ternary catalyst 13, an oxygen sensor 14 for detecting the oxygen concentration in the exhaust gas is attached. The oxygen sensor 14 is coupled to a control unit 15. The control unit 15 electrically controls a fuel injection valve 16 mounted on an intake path of the engine 11, using a microcomputer. More specifically, the control unit 15 controls an injection amount of a fuel, based on an air-fuel ratio detected by the oxygen sensor 14 and vehicle running conditions (speed, throttle opening degree, engine speed, crank angle, water temperature, brake signal, air flow meter, etc.).

The oxygen sensor 14 has a known structure in which the electrical output is changed depending on the oxygen concentration in the exhaust gas flowing through the exhaust outlet 12. The structure and material of the oxygen sensor are not restricted. As an example of the oxygen sensor 14, a known wide range oxygen sensor (universal exhaust gas oxygen sensor) is used which detects an oxygen concentration in a wide range extending from the richer side to the leaner side with respect to the theoretical air-fuel ratio as the center.

Figure 3:
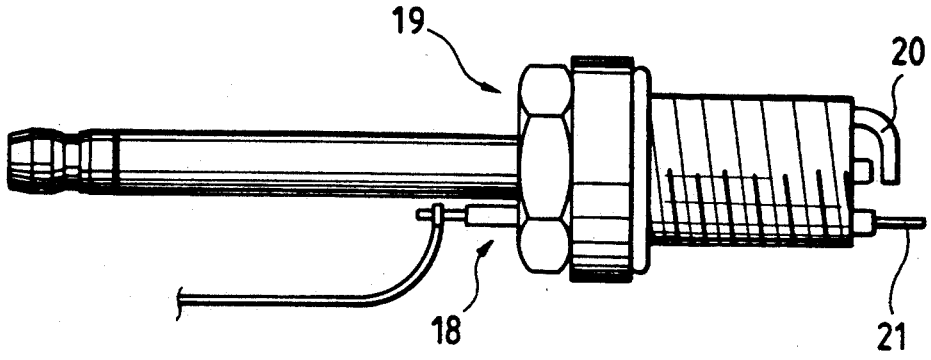
FIG. 3 is a side view showing a spark plug provided with an electrode plug as a unit.

In the control unit 15, the air-fuel ratio detected by the oxygen sensor 14 is corrected using an output of an electrode plug 18 which detects the flame resistance in a combustion chamber 17 of the engine 11. As shown in FIG. 3, the electrode plug 18 used in this embodiment is united with a spark plug 19 to form one body so as to measure the flame resistance between an outer electrode 20 of the spark plug 19 and a voltage applying electrode 21 of the electrode plug 18.

Figure 4:
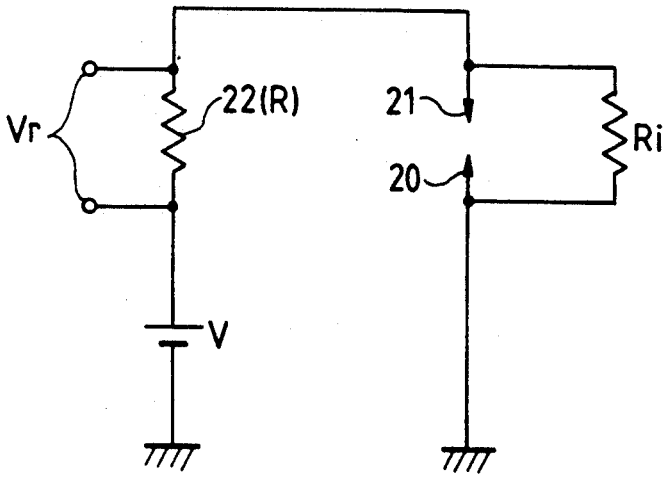
FIG. 4 is a diagram of an electrical circuit for measuring a flame resistance.

The flame resistance is obtained by a circuit shown in FIG. 4 and the following equation:

$$Ri = R(V - Vr) / Vr \qquad (I)$$

wherein Ri indicates a flame resistance between the outer electrode 20 and the voltage applying electrode 21, R a resistance of a series resistor 22, V an applied voltage, and Vr a voltage appearing across the series resistor 22.

Figure 5:
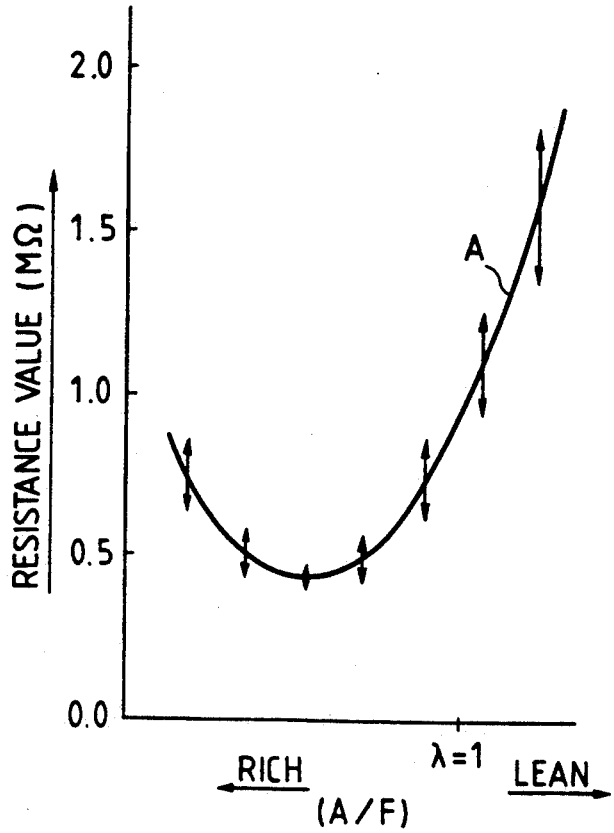
FIG. 5 is a graph showing a relationship between a minimum value of the flame resistance and an air-fuel ratio.

FIG. 5 shows a relationship between the minimum value of the flame resistance Ri and the air-fuel ratio. As shown in FIG. 5, even if the explosion is performed constantly in the combustion chamber 17, the minimum value of the flame resistance Ri varies depending on the mixing condition of the fuel or other conditions (see arrows in FIG. 5). By calculating the average value, however, the flame resistance Ri can be plotted as a curve A corresponding to the actual air-fuel ratio.

Then, in the control unit 15 of this embodiment, the air-fuel ratio is obtained from the average value of the minimum values of the flame resistance Ri of each combustion cycle and the curve shown in FIG. 5 (herein, the obtained air-fuel ratio is referred to as "reference air-fuel ratio"), and the reference air-fuel ratio is compared with the air-fuel ratio detected by the oxygen sensor 14 to obtain a difference. From the difference, a correction value for correcting the air-fuel ratio detected by the oxygen sensor 14 is calculated.

Figure 6:
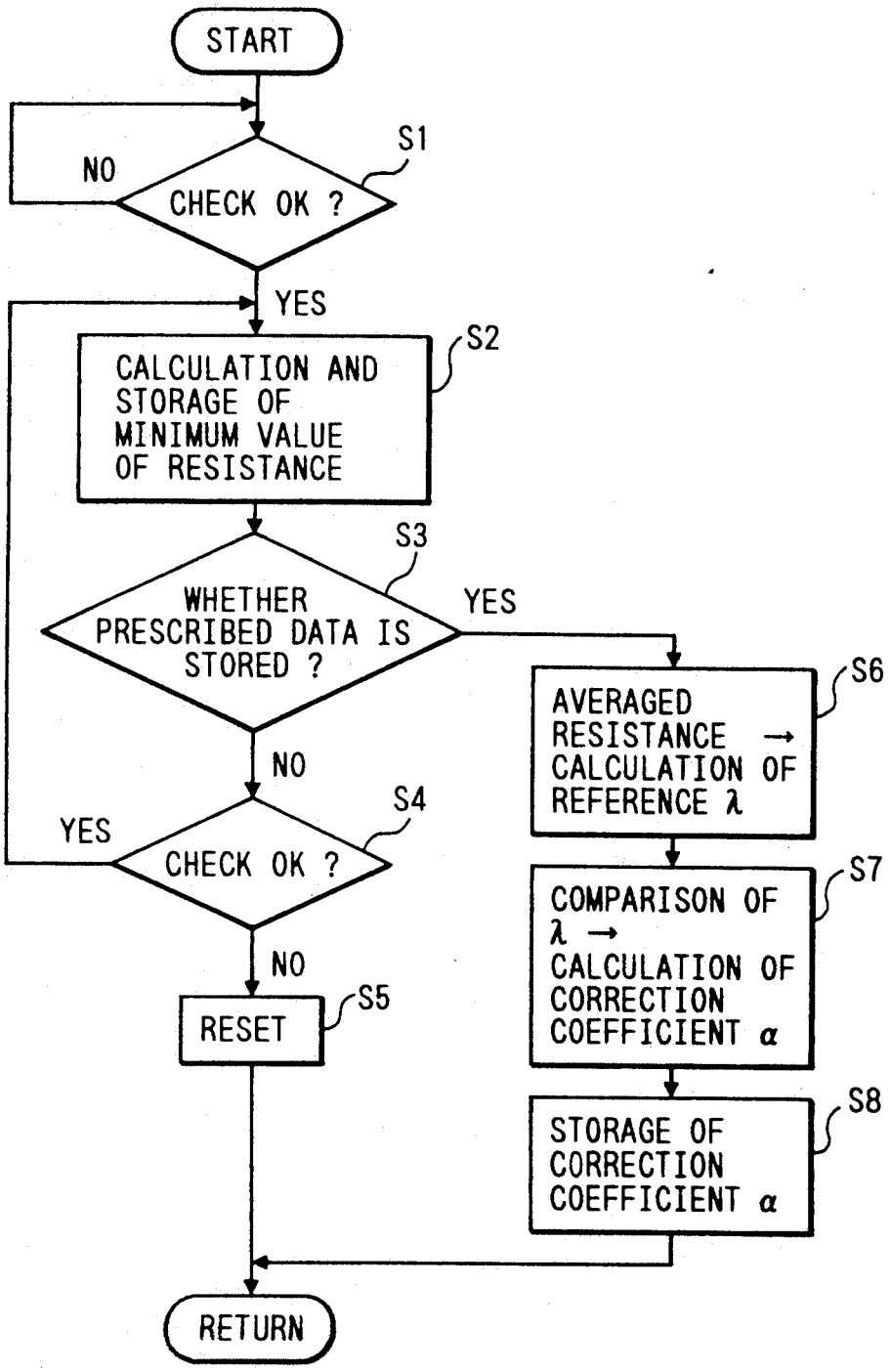
FIG. 6 is a flowchart for calculating a correction coefficient.
Figure 7:
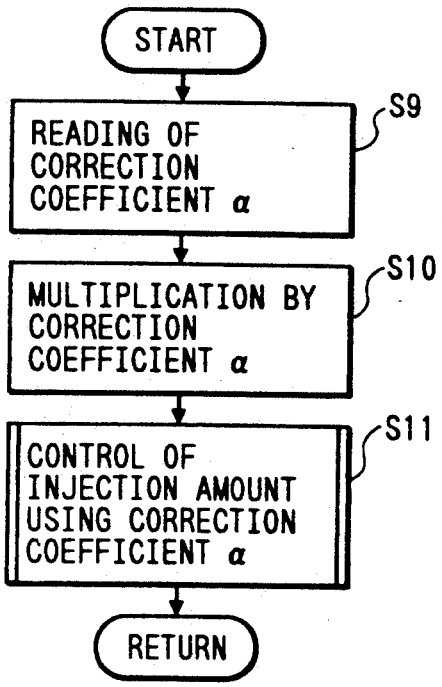
FIG. 7 is a flowchart for correcting an air-fuel ratio detected by an oxygen sensor.

An example of the control in the calculation of the correction value will be described with reference to a flowchart shown in FIG. 6.

Figure 11:
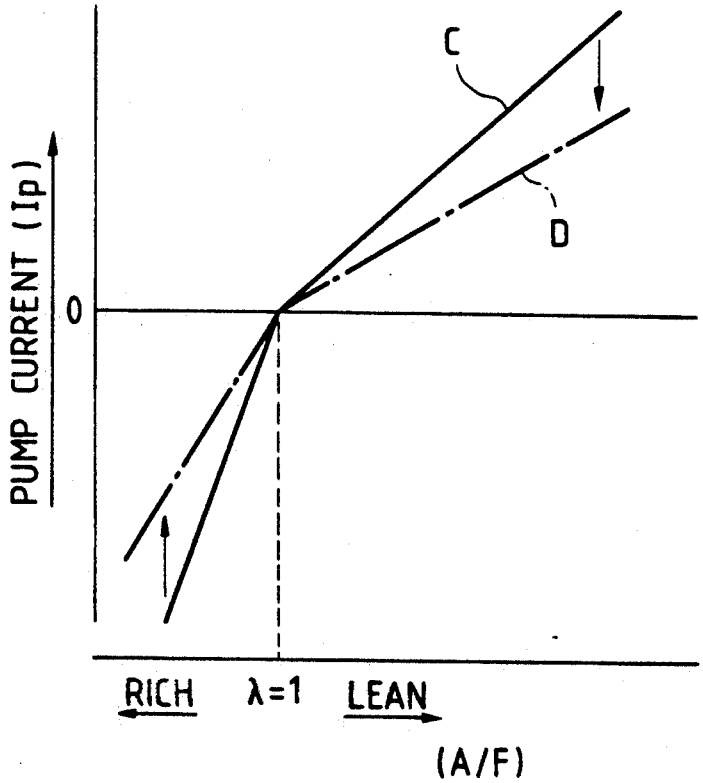
FIG. 11 is a graph showing the aged deterioration of a wide area oxygen sensor.

When the engine 11 is started (START), it is judged whether or not the running conditions of the engine 11 are suitable for checking the air-fuel ratio on the basis of the flame resistance Ri. That is, it is judged whether or not the running conditions of the engine are stable at a position other than the vicinity of the theoretical air-fuel ratio ($\lambda = 1$) because, as shown in FIG. 11, when the oxygen concentration is measured by the wide range oxygen sensor using a pump current, the variation due to the deterioration is small in the vicinity of the theoretical air-fuel ratio (step S1). (Step S1 will be described later in detail.) If the judgment is NO, the process returns to step S1. If YES, the flame resistances Ri are calculated and the minimum value of the flame resistance Ri is stored (step S2). (Step S2 will be described later in detail.) Thereafter, it is judged whether or not a prescribed number of data have been stored. That is, for example, it is judged whether or not the minimum values of the flame resistance Ri for several tens explosion strokes or more have been stored (step S3). If the judgment is NO, it is judged whether the running conditions of the engine 11 suitable for the air-fuel ratio checking on the basis of the flame resistance Ri remain to continue or not (step S4). If the judgment is YES, the process returns to step S2. If the judgment in step S4 is NO, the stored data of the minimum values of the flame resistance Ri are reset (step S5) and the process is returned.

If the judgment in step S3 is YES, the stored minimum values of the flame resistance Ri for the prescribed number of explosion strokes are averaged, and a reference air-fuel ratio is calculated from the averaged value and data corresponding to the graph A shown in FIG. 5 and stored in a ROM (not shown) of the control unit 15 (step S6). Then, the reference air-fuel ratio calculated in step S6, and the air-fuel ratio detected by the oxygen sensor 14 (if desired, this may be also averaged) are compared with each other. From this difference, a correction coefficient $\alpha$ for correcting the air-fuel ratio detected by the oxygen sensor 14 is obtained (alternatively, a correction coefficient for the lean side, and a correction coefficient for the rich side may be separately obtained) (step S7). The calculated correction coefficient $\alpha$ is stored in the not-shown RAM of the control unit 15 (step S8), and then the process is returned.

The control for correcting the air-fuel ratio detected by the oxygen sensor 14 using the above correction coefficient $\alpha$, and the control of the air-fuel ratio of the engine 11 using the corrected air-fuel ratio are performed independently of the above-described control. An example of the controls will be briefly described with reference to a flowchart shown in FIG. 7.

When the engine 11 is started (START), the correction coefficient $\alpha$ stored in the control unit 15 is firstly read out (step S9). Then, the air-fuel ratio detected by the oxygen sensor 14 is multiplied by the correction coefficient $\alpha$ (step S10). Using the vehicle running conditions and the corrected air-fuel ratio, the fuel injection valve 16 is controlled by a known control technique (step S11).

The air-fuel ratio calculation means of the present invention for calculating the reference air-fuel ratio from the minimum value of the flame resistance is implemented by steps S1 to S6 mentioned above. The air-fuel ratio correction means for correcting the air-fuel ratio detected by the oxygen sensor using the reference air-fuel ratio is implemented by step S7 to S10 mentioned above.

The step S1 in which it is judged whether or not the running conditions of the engine are stable, will be described in more detail.

Although the minimum value of the flame resistance [Ri]min is dominantly affected by the air-fuel ratio, it is also affected by swirl (number of rotation), fill factor of charging (load), ignition timing advance and the like through the influence of the flame temperature (see collection of papers of Mechanical Society vol. 33, No. 252, Page 1278–1287. Accordingly, when the minimum value of the flame resistance [Ri]min is measured, it is necessary to take a step in which it is confirmed in advance whether or not the running conditions meet predetermined conditions. Of course, the step may be judged as yes if any one of a plurality of predetermined conditions as described above (running conditions) is met. The curve of [Ri]min versus air-fuel ratio (A/F) as shown in FIG. 5 under the respective conditions may be obtained in advance by a bench test, or it may be obtained through learning during usage of the engine mounted with an A/F sensor while the sensor is new and does not deteriorate.

Figure 8:
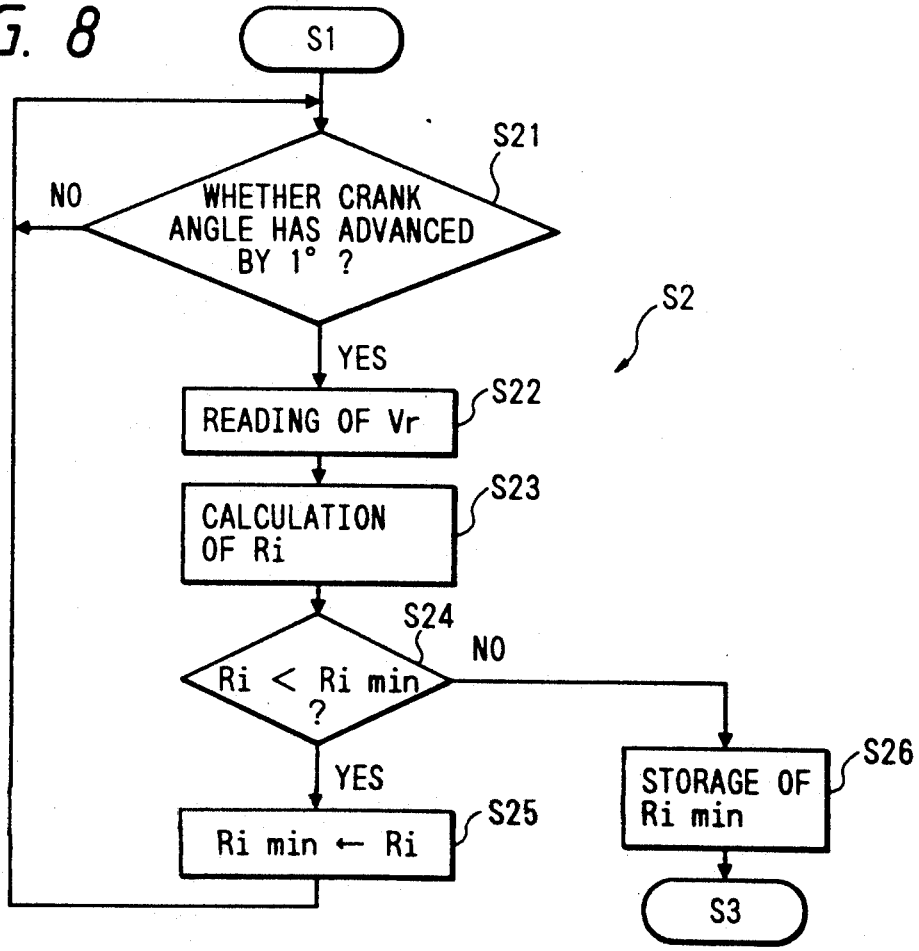
FIG. 8 is a flowchart for reading the minimum value of the flame resistance.
Figure 10:
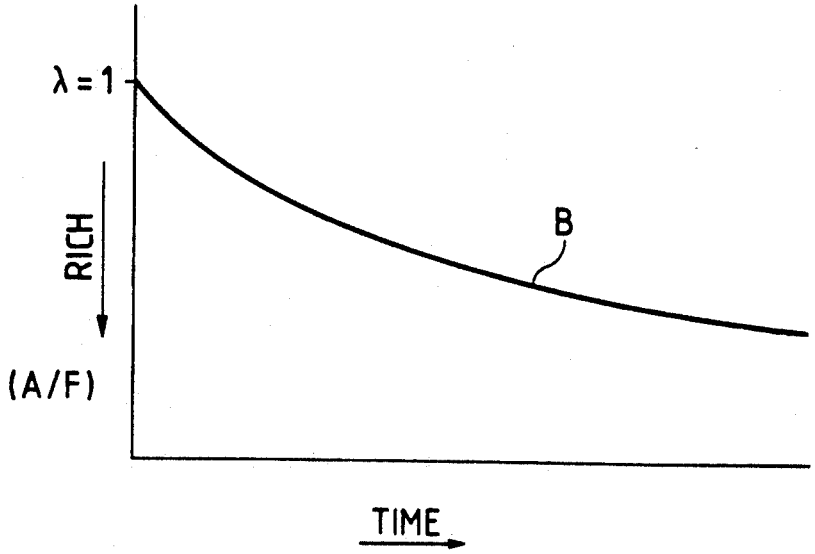
FIG. 10 is a graph showing the aged deterioration of a λ point oxygen sensor.

The step S2 will be described in more detail with reference to the flow chart shown in FIG. 8.

In this embodiment, the flame resistance is measured for every crank angle of 1°. First, it is judged whether or not the crank angle measured by a crank angle sensor has advanced by 1° (step S21). If the judgement is NO, the process is returned to step S21. If the judgement in step S21 is YES, the voltage Vr appearing across the series resistor 22 is read (step S22), and the flame resistance Ri is calculated from the equation (I) described before (step S23). Next, it is judged whether or not the flame resistance Ri calculated this time is smaller than Ri min (step S24). Since Ri min is cleared up at the initial stage of one cycle of combustion, the read value at the first time is smaller than Ri min. If the judgement in step S24 is YES, the flame resistance Ri calculated this time is made Ri min (step S25). That is, when the flame resistance Ri is lowering, Ri min is sequentially changed to smaller value. If the judgement in step S24 is NO, that is, when the flame resistance begins to rise, the value of Ri min at the previous time is stored as the minimum value of the flame resistance Ri in this cycle (step S26).

The reference air-fuel ratio obtained from a flame resistance is not influenced by aged deterioration. For the air-fuel ratio detected by the oxygen sensor 14, the correction coefficient is updated using the reference air-fuel ratio which is not influenced by aged deterioration, every time when any one of the predetermined running conditions of the engine 11 is met and become stable. Therefore, even if the oxygen sensor 14 is used for a long period and the air-fuel ratio detected by the oxygen sensor is changed, an accurate air-fuel ratio can always be available from the updated correction coefficient and the output detected by the oxygen sensor 14.

In other words, the air-fuel ratio control apparatus of the embodiment can properly control the air-fuel ratio of the engine 11 based on an accurate air-fuel ratio, even when the oxygen sensor 14 is used for a long period.

Moreover, in this embodiment, the structure having only a single oxygen sensor 14 can cope with the aged deterioration of the sensor. Therefore, as compared with the prior art technique in which two oxygen sensors are used for coping with the aged deterioration, the production cost of the air-fuel ratio control apparatus can be reduced.

In the above description, an example in which the flame resistance value is calculated for every advance of 1° of the crank angle so as to obtain the minimum value, is described. Alternatively, the flame resistance value may be always calculated. In another example, the minimum value of the flame resistance is analogically calculated using a well-known circuit as "peak-held circuit". In that circuit, a capacitor is charged through a diode by a charging voltage proportional to the instant flame-resistance. In this way, the minimum value of the flame resistance can be obtained by any other appropriate technique.

In the above embodiment, the wide range oxygen sensor (UEGO sensor) is used as the oxygen sensor. Alternatively, in the invention, any other types of oxygen sensors including a λ point sensor which detects the air-fuel ratio in the vicinity of the theoretical air-fuel ratio by the rapid change in its output, can be used.

In another example, the control apparatus may be constructed so that, when the difference between the air-fuel ratio detected by the oxygen sensor and the reference air-fuel ratio measured by the electrode plug reaches a prescribed value, the user is informed that the oxygen sensor is required to be exchanged.

In the above embodiment, the electrode plug and the spark plug are formed into one unit, but alternatively, they can be separately provided in the combustion chamber. Alternatively, the flame resistance may be measured using a spark discharge gap of the spark plug.

In the above embodiment, the reference air-fuel ratio is once calculated from the minimum value of the flame resistance. Since the minimum value of the flame resistance corresponds to the reference air-fuel ratio, the air-fuel ratio detected by the oxygen sensor may be corrected using the minimum value of the flame resistance.

In the above embodiment, for the simplicity of the description, a single-cylindered engine is shown. However the present invention can be applied to a control apparatus for a multi-cylindered engine. In such a case, the flame resistance value may be measured for each cylinder, or the flame resistance value for a representative one or some of the cylinders may be measured.

Figure 9:
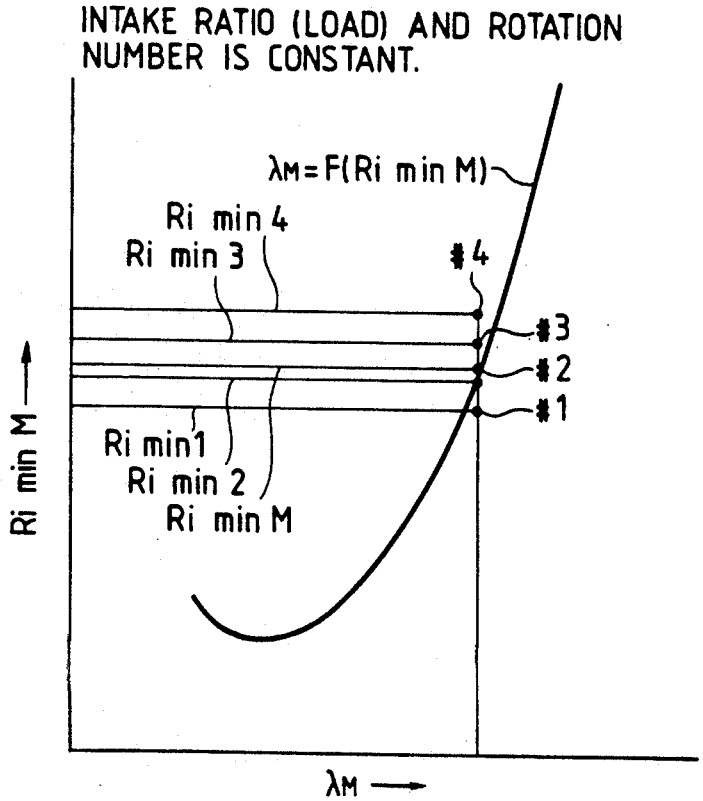
FIG. 9 is a diagram showing variation of a minimum value of the flame resistance of each cylinder.

A case where one air-fuel ratio sensor and one electrode plug is used for a multi-cylindered engine will be described with reference to FIG. 9.

Under constant running conditions, it is assumed that the minimum value of flame resistance of each cylinder is Ri min1, . . . Ri min4 (in case of four cylinders) (see FIG. 9), the average value thereof is $$Ri\ \mathrm{minM} = \frac{Ri\ \mathrm{min1} + \ldots + Ri\ \mathrm{min4}}{4} \quad (1)$$

and the average value of air-fuel ratio is $\lambda_M$, then the following relation between Ri minM and $\lambda_M$ is presumed.

$$\lambda_M = F(Ri\ minM) \quad (2)$$

Also, the following relation is presumed irrespective of deterioration of the sensor:

$$Ri\ min\ M \approx k_3 \cdot Ri\ min3 \quad (3)$$

(where $k_3$ is constant)

Then, $$\lambda_M = F(Ri\ min\ M) = F(k_3 \cdot Ri\ min3) \quad (4)$$

It will be considered a case where $\lambda_M$ is controlled by feedback to a target value $(\lambda_M x)_o$.

Under this feedback control, it is assumed that a sound sensor such as a new sensor which has not been deteriorated, is used and the output of the sensor at that time is $(\lambda_{MS})_0$, then $$(\lambda_M)_0 = (\lambda_{MS})_0 \quad (5)$$

Further, the minimum value of the flame resistance at that time is expressed by $(\mathrm{Ri\ minM})_0$, $(\mathrm{Ri\ min3})_0$.

Now, it is assumed that the sensor is deteriorated so that under the above feedback control, $\lambda_M$ has been controlled to $(\lambda_M)_0'$, and Ri minM and Ri min3 have been changed to $(\text{Ri minM})_0$, $(\text{Ri min3})_0'$ respectively. Then, $(\lambda_M)_0'$ is expressed as follows:

$$(\lambda_M)_0' = (\lambda_M)_0 + \Delta\lambda_M \quad (6)$$

$$= (\lambda_M)_0 + \left(\frac{dF(Ri\ \text{minM})}{d(Ri\ \text{minM})}\right)_{Ri\ minM=(Ri\ minM)_0} \cdot \Delta Ri\ \text{minM}$$

$$= (\lambda_M)_0 + \left(\frac{dF(Ri\ \text{minM})}{d(Ri\ \text{minM})}\right)_{Ri\ minM=(Ri\ minM)_0} \cdot k_3 \cdot \Delta Ri\ \text{min3}$$

where $\Delta\text{Ri min3} = (\text{Ri min3})' - (\text{Ri min3})_0$.

In equation (6), $(\lambda_M)_0$ is given by, for example, equation (5), $$\left(\frac{dF(Ri\ \text{minM})}{d(Ri\ \text{minM})}\right)_{Ri\ minM=(Ri\ minM)_0}$$

and $k_3$ are determined in advance by a bench test within a required range. $(\text{Ri min3})_0$ is obtained and stored through learning under an initial state of the sensor which has not been deteriorated. $(\text{Ri min3})_0'$ is obtained every time from the output of an electrode plug by a digital calculation or analogic method so that $(\lambda_M)_0'$, that is, the reference value of $\lambda_M$ as an actual value of $\lambda_M$ can be obtained.

Then, the difference between $(\lambda_M)_0'$ and $(\lambda_{MS})_0'$ is an output error according to deterioration of the sensor, which is used as the correction value for the sensor output. Also, it may be designed that when the difference becomes a predetermined value, it is judged that the sensor should be replaced.

Where, the output value $(\lambda_{MS})_0'$ of the sensor can be equal to the value of $(\lambda_M)_0$ if the feedback control has been conducted by using directly the raw output value $(\lambda_{MS})_0'$, and $(\lambda_{MS})_0'$ can be calculated by using the value of $(\lambda_M)_0$ and a correction value $\Delta\lambda_{MS}$ for the raw output value $(\lambda_{MS})_0'$ if any feedback control has been conducted by using that corrected value $[(\lambda_{MS})_0' + \Delta\lambda_{MS}]$ of the raw output value $(\lambda_{MS})_0'$ which has been corrected by the correction value $\Delta\lambda_{MS}$ above.

What is claimed is:

1. An air-fuel ratio control apparatus, comprising:

an oxygen sensor, provided in an exhaust outlet of an engine, for detecting an oxygen concentration in exhaust gas; and a control unit for correcting and controlling an air-fuel ratio of said engine depending on an oxygen concentration in an exhaust gas detected by said oxygen sensor, wherein said control unit comprises:

an electrode plug for detecting a flame resistance in a combustion chamber of :d engine;

air-fuel ratio calculation means for calculating a reference air-fuel ratio from a minimum value of the flame resistance detected by said electrode plug; and air-fuel ratio correction means for correcting the air-fuel ratio detected by said oxygen sensor, using the reference air-fuel ratio calculated by said air-fuel ratio calculation means, and wherein said control unit corrects and controls the air-fuel ratio of said engine based on an air-fuel ratio corrected by said air-fuel ratio correction means.

2. A method of detecting deterioration of an air-fuel sensor which is used for controlling an air-fuel ratio of an engine, comprising the steps of:

obtaining a minimum value of a flame resistance in a combustion chamber of said engine in one cycle of combustion;

calculating a mean value of the minimum value of the flame resistance for a plurality of cycles of combustion;

obtaining a reference air-fuel ratio based on the mean value and predetermined data as to a relation between a minimum value of the flame resistance and an air-fuel ratio;

comparing the reference air-fuel ratio with the air-fuel ratio obtained by said air-fuel sensor to obtain a difference; and judging the deterioration of said air-fuel sensor based on the difference.

* * * * *